US005459889A

United States Patent [19]

Jamison

[11] Patent Number: 5,459,889

[45] Date of Patent: Oct. 24, 1995

[54] WATER CLOSET SEAT HANDLE

[76] Inventor: Etta M. Jamison, 913 Homer Ave., Toledo, Ohio 43608

[21] Appl. No.: 168,772

[22] Filed: Dec. 16, 1993

[51] Int. Cl.[6] ..... A47K 13/10

[52] U.S. Cl. ..... 4/661; 4/246.1

[58] Field of Search ..... 4/246.1, 253, 661; D8/306, 307; 116/112, 124

[56] References Cited

U.S. PATENT DOCUMENTS

| | | | |
|---|---|---|---|
| D. 223,698 | 5/1972 | Javkin | D8/154 |
| D. 229,026 | 11/1973 | Javkin | D8/306 |
| D. 309,091 | 7/1990 | Shepard | 4/246.1 X |
| 1,999,555 | 4/1935 | Adams | 4/251 |
| 2,473,082 | 6/1949 | Warner | 4/251 |
| 4,150,446 | 4/1979 | Crocker | 4/251 |
| 4,763,362 | 8/1988 | Eure | 4/253 X |
| 5,240,212 | 8/1993 | Brodie | 4/661 X |
| 5,369,819 | 12/1994 | Capuano | 4/661 |

FOREIGN PATENT DOCUMENTS

| | | |
|---|---|---|
| 281021 | 12/1914 | Germany . |
| 651230 | 10/1937 | Germany . |

*Primary Examiner*—Charles E. Phillips
*Attorney, Agent, or Firm*—Willian Brinks Hofer Gilson & Lione

[57] ABSTRACT

A handle for raising and lowering a seat of a water closet. The handle includes a first arm and a second arm, a grip member extending between and connecting the first arm and the second arm, and a means for attaching the first arm and the second arm to the seat. The first and second arm each include a hinge to allow the handle to pivot between a fully extended position and a retracted position. The handle may include a retention strap. The retention strap is attached to the water closet and releaseably around the handle such that the strap secures the seat in a raised position thereby preventing the seat and cover from inadvertently dropping when bumped.

3 Claims, 1 Drawing Sheet

WATER CLOSET SEAT HANDLE

FIELD OF THE INVENTION

This invention relates to a water closet seat handle. More particularly, this invention relates to a water closet seat handle for raising and lowering a water closet seat and a means for fixing the water closet seat in position.

BACKGROUND OF THE INVENTION

The surfaces of a water closet seat are exposed to the contents of the bowl and when it is desirable to raise or lower the seat, some part of the seat must be grasped with the fingers. Not only is this is an undesirable and unsanitary condition but the seat is difficult for small children and disabled persons to grasp securely. In view of the foregoing it will be appreciated that there is a significant need for a hygienic means for raising and lowering the seat that does not require that some part of the seat be grasped with the fingers and that is simple for small children and disabled persons to effectively grasp. In addition to the problems associated with grasping the seat, it will recognized that when the seat is in the raised position it may be inadvertently bumped and fall to the lower position thereby potentially damaging the seat or injuring small children and disabled persons as they attempt to grasp the seat.

To alleviate the aforementioned problems, I have invented a novel seat handle which may be used to raise and lower the seat without grasping the seat with the fingers. Moreover, to prevent the seat from inadvertently dropping from the raised position I have also invented a novel security strap which may be used in cooperation with the seat handle to secure the seat in a fixed raised position thereby preventing the seat from inadvertently dropping.

Accordingly, one aspect of the present invention is to provide a water closet Seat handle that may be easily attached to most any water closet seat. Another aspect of the present invention is to provide a water closet seat handle that is simple and economical to manufacture. Yet another aspect of the present invention is to provide a water closet seat handle that promotes hygiene and is helpful to disabled persons. Yet another aspect of the present invention is to provide a water closet seat handle that is hinged.

SUMMARY OF THE INVENTION

Briefly, according to this invention there is provided a handle for raising and lowering a seat of a water closet. The handle includes a first arm and a second arm, a grip member extending between and connecting the first arm and the second arm, and a means for attaching the first arm and the second arm to the seat. The first and second arm each include a hinge to allow the handle to pivot between a fully extended position and a retracted position. In the fully extended position the handle extends from the side of the seat below a plane formed by a top of the seat to facilitate gripping the handle and preventing the handle from hindering use of the water closet and in the fully retracted position the handle folds above the plane formed by the top of the seat.

In one embodiment, the first arm and the second arm are attached to the underside of the seat by screws or an adhesive. In another embodiment, the first arm and the second arm of the handle are received within at least one bracket installed on the underside of the seat. The at least one bracket includes at least one opening configured and sized to receive and hold an end of the first arm and the second arm such that the first arm and the second arm may be removably inserted into the opening of the bracket and the seat raised or lowered as desired.

The handle further includes a retention strap. The retention strap is attached to the water closet and releaseably around the handle such that the strap secures the seat in a raised position thereby preventing the seat and cover from inadvertently dropping when bumped. More particularly, an end of the retention strap is fixed to the water closet and the retention strap is looped between the first arm, the second arm and the grip member and through the handle and releasably fastened to the fixed end of the retention strap thereby forming a closed ring.

BRIEF DESCRIPTION OF THE DRAWINGS

Further features and other aspects and advantages of this invention will become clear from the following detailed description made with reference to the drawings in which.

DESCRIPTION OF THE PREFERRED EMBODIMENTS

Figure 4:
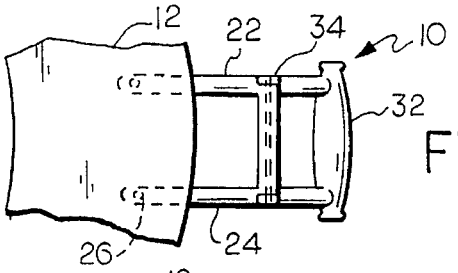
FIG. 4 is an enlarged partial top view of a handle and seat in accordance with the present invention.

Referring to the drawings, wherein like reference characters represent like elements, FIGS. 1–9 illustrate a water closet seat handle 10 for raising and lowering a seat 12 of a water closet 14 in accordance with the present invention. The water closet 14 is of a conventional design having a bowl 16, seat 12, cover 18 and water tank 20. The seat 12 is mounted on hinged arms which are rotatably mounted on a hinged rod. The hinged rod is supported from the bowl by brackets fastened to the rear of the rim of the bowl 16 of the water closet 14. As known in the art, the cover 18 is also hinged at the rear of the rim and may rest upon the seat 12 to cover the seat.

Figure 5:
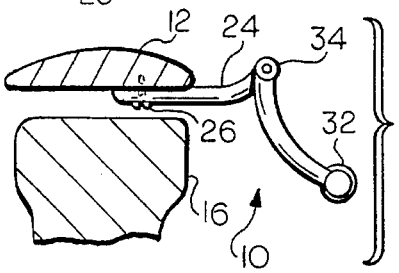
FIG. 5 is an enlarged partial side view of the handle of FIG. 4.
Figure 1:
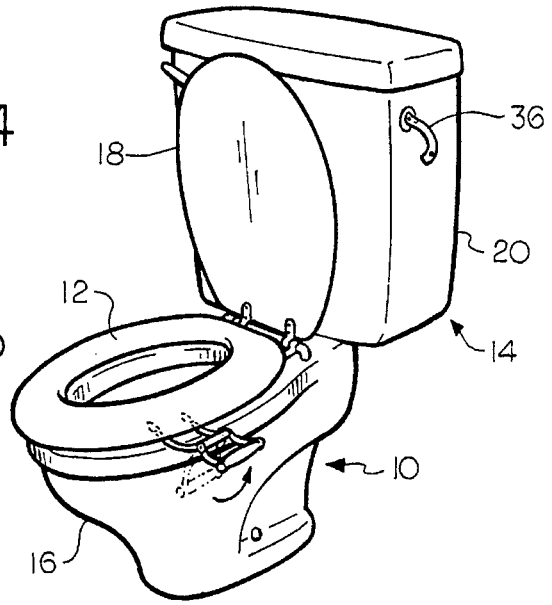
FIG. 1 is a perspective view of a water closet including a handle secured to a seat in the lower position and a retention strap.
Figure 6:
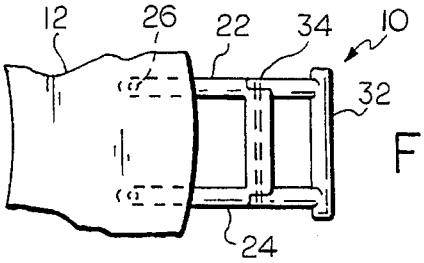
FIG. 6 is an enlarged partial top view of a handle and seat in accordance with the present invention.
Figure 7:
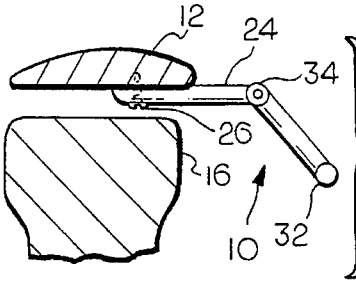
FIG. 7 is an enlarged partial side view of the handle of FIG. 6.

The water closet handle 10 in accordance with the present invention includes a first and second arm, 22 and 24, extending parallel and laterally outward from the side of the seat 12. The first and second arm, 22 and 24 may be formed straight as shown in FIGS. 6 and 7 or curved as shown in FIGS. 4 and 5. It will be appreciated, that a curved first and second arm 22 and 24 may fold away and under the bowl 16 when at rest (FIG. 1). The first and second arm, 22 and 24, may be formed from most any suitable material that is durable and may be easily cleaned, for example metal or plastic. In a preferred embodiment, each arm, 22 and 24, is made from a metal stamping and can be metal plated to blend with the other fixtures present in the bathroom.

Figure 8:
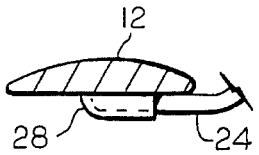
FIGS. 8 is an enlarged partial side view of an arm and bracket attached to a seat in accordance with the present invention.
Figure 9:
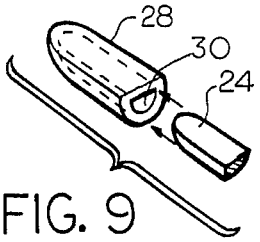
FIG. 9 is an exploded view of the arm and bracket of FIG. 8.
Figure 3:
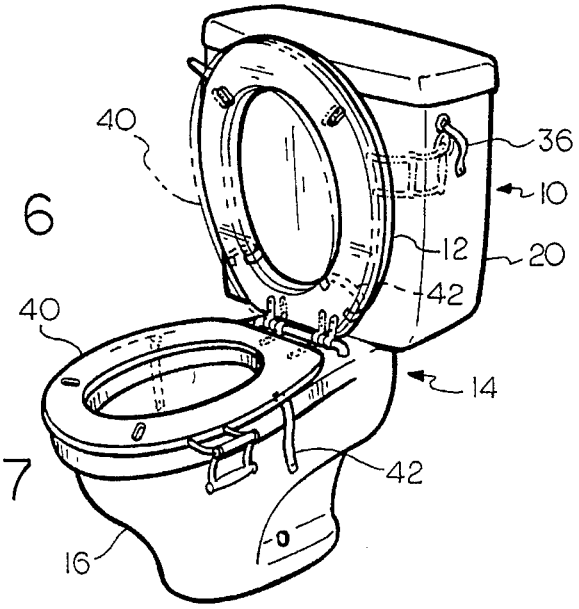
FIG. 3 is a perspective view of a water closet showing a snap system and a handle secured to a disk in the lower position, and showing the disk and seat assembly in the raised position.

As shown in FIGS. 4, 5, 6 and 7, each arm 22 and 24 may be attached flat against the underside of the seat 12 by screws 26 or other suitable means such as an adhesive. In another embodiment of the present invention as shown in FIGS. 8 and 9, at least one, and preferably two brackets 28, may be installed on the underside of the seat 12 to receive each arm 22 and 24 of the handle 10. The brackets 28 include an opening 30 configured and sized to receive and hold an end of each arm 22 and 24 of the handle 10. The arms 22 and 24 of the handle 10 may be inserted into the openings 30 of the brackets 28 and the seat 12 raised or lowered as desired and then the handle may be removed from the brackets. It will be appreciated that by removably securing the handle 10 to the underside of the seat 12 a single handle may be used on a number of different seats at different locations. In yet another embodiment of the present invention as shown in FIG. 3, each arm 22 and 24 is secured to a disk 40 which fits under the seat 12. The disk 40 is similar in shape to the seat 12 and is secured to the seat by a snap system 42 or the like. The disk 40 may easily be removed for cleaning or, if desired, removed for installation on a different seat 12.

The first and second arm 22 and 24 of the handle 10 are connected by a grip member 32. The grip member 32 extends perpendicularly between the first arm 22 and the second arm 24. The grip member 32 may be formed from most any suitable material such as plastic, metal or plastic coated metal and the like. The grip member 32 of the handle 10 is of such a curvature and contour as to provide a surface that may be easily and effectively grasped by the fingers. Furthermore, it will be appreciated that the contour of the handle 10 is designed so that no obstructions or sharp edges are present as to impede cleaning.

The first and second arm 22 and 24 of the handle 10 each include a hinge 34 approximately mid-length of arms 22 and 24 to allow the handle to pivot from a fully extended position to a retracted position (FIG. 1). It will be appreciated that when the handle 10 is at rest, FIG. 3, the handle is bent from the side of the seat 12 thereby moving the handle below the plane formed by the top of the seat and spaced away from the side of the seat to make gripping the handle easier and prevent the handle from hindering use of the water closet 14 and, when the handle is retracted and folded, the grip member 32 is above the plane formed by the top of the seat. To raise or lower the seat 12, the handle 10 may be simply grasped with the fingers and pulled upward or, if desired, lowered thereby pivoting the arms 22 and 24 at the hinge 34 and folding the first and second arms.

Figure 2:
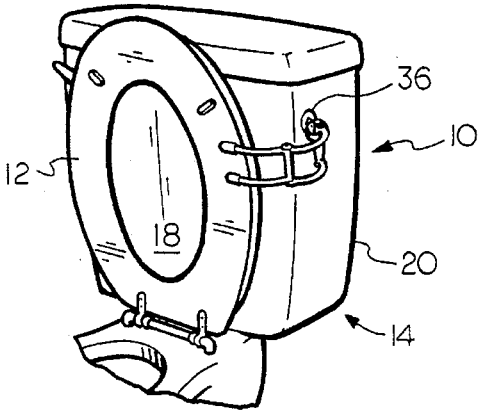
FIG. 2 is a partial perspective view of a water closet including a handle secured to a seat in the raised position and a retention strap.

As shown in FIGS. 1–3, to prevent the seat 12 from inadvertently dropping from a raised position, a retention strap 36 may be attached to the tank 20 and releaseably around the handle 10. The retention strap 36 may be made of most any suitable fabric material such as nylon or a cotton weave. One end of the retention strap 36 is fixed to the tank 20 by an adhesive means or a fastener means and the like and looped between the first arm 22 and the second arm 24 and the grip member 32 and, preferably, fastened to the fixed end of the retention strap 36 thereby forming a closed ring. The retention strap 36 may be fastened to itself by a snap system or most any other suitable means. The retention strap 36 holds the handle 10 and secures the seat 12 in a raised position thereby preventing the seat and cover 18 from inadvertently dropping when bumped.

Though the water closet seat handle 10 and retention strap 36 have been described and illustrated in the preferred manner, it is recognized that in practice the elements of this invention as claimed may be formed of other materials in other shapes and sizes as desired by one skilled in the art.

Having described presently preferred embodiments of the invention, it is to be understood that it may be otherwise embodied within the scope of the appended claims.

What is claimed is:

1. A handle for raising and lowering a seat of a water closet, said handle comprising:

a first arm and a second arm;

a grip member extending between and connecting said first arm and said second arm;

a means for attaching said first arm and said second arm to the seat, said first arm and second arm each including a hinge to allow said handle to pivot between a fully extended position and a retracted position; and a retention strap, said retention strap attached to the water closet and releasably around said handle such that said strap secures the seat in a raised position thereby preventing the seat and cover from inadvertently dropping when bumped.

2. The handle of claim 1 wherein an end of said retention strap is fixed to the water closet and said retention strap is looped between said first arm, said second arm and said grip member and through the handle and releasably fastened to said fixed end of said retention strap thereby forming a closed ring.

3. The handle of claim 2 wherein said retention strap is releasably fastened to said fixed end by a snap system.

* * * * *